United States Patent [19]

Sauer

[11] 4,323,945

[45] Apr. 6, 1982

[54] POLARIZED ELECTROMAGNETIC RELAY

[75] Inventor: Hans Sauer, Fichtenstrasse 5, Deisenhofen, Fed. Rep. of Germany, D-8024

[73] Assignees: Matsushita Electric Works, Ltd., Kadoma, Japan; Hans Sauer, Deisenhofen, Fed. Rep. of Germany

[21] Appl. No.: 115,056

[22] Filed: Jan. 24, 1980

[30] Foreign Application Priority Data

Jan. 25, 1979 [DE] Fed. Rep. of Germany ..... 2902870

[51] Int. Cl.[3] ..... H01H 51/22; H01H 51/30

[52] U.S. Cl. ..... 361/160; 335/194; 335/192; 335/78

[58] Field of Search ..... 335/194, 192, 128, 135, 335/133, 193, 157, 78; 361/160; 200/245, 246, 255, 256, 257

[56] References Cited

U.S. PATENT DOCUMENTS

| | | | |
|---|---|---|---|
| 2,833,885 | 5/1958 | Wells et al. | 335/192 |
| 3,634,793 | 1/1972 | Sauer | 335/78 |
| 4,087,667 | 5/1978 | Heider et al. | 335/192 |

FOREIGN PATENT DOCUMENTS

| | | |
|---|---|---|
| 1213917 | 10/1966 | Fed. Rep. of Germany . |
| 2454967 | 12/1976 | Fed. Rep. of Germany . |

OTHER PUBLICATIONS

"Relais Lexikon", by H. Sauer, 1975, p. 12.

"Publication Elektronik", vol. 60, Issue 24 of Dec. 27, 1978, p. 43.

*Primary Examiner*—Harold Broome

*Attorney, Agent, or Firm*—Schwartz, Jeffery, Schwaab, Mack, Blumenthal & Koch

[57] ABSTRACT

A polarized electromagnetic relay includes two contact springs extending substantially parallel to each other.

One of the contact springs forms a movable contact for cooperation with a fixed contact. In the contacting condition, the free ends of the contact springs touch each other. A first actuator portion of a relay armature serves to move the contact springs into the contacting position, and a second actuator portion serves to move the contact springs in the opposite direction to open the contact. The ratio of the spring lengths between the second actuator portion and the movable contact, divided by the thickness of this length of contact spring is smaller than the ratio of the spring lengths between the first actuator portion and the touching location of the two contact springs, divided by the thickness of this length of contact spring. A contact spring arrangement is thereby achieved in which an essential portion of the permanent-magnetic pull of the armature is stored in the contact springs as the contact force. At the same time, a positive and forced contact opening is achieved with a contact clearance unaffected by contact spring bending.

12 Claims, 9 Drawing Figures

POLARIZED ELECTROMAGNETIC RELAY

BACKGROUND OF THE INVENTION

In the contact spring arrangement disclosed in German Pat. No. 1,213,917, an essential portion of the pull exerted by the armature is stored in a double contact spring. Accordingly, practically no excitation energy is required to provide the contact force. In the known arrangement, an actuating nipple is disposed between the free ends of a bifurcated spring which has the same flexibility in both directions of its actuation. It is necessary that the contact clearance is smaller than the travelling distance of the armature by the path of travel required by the spring in either direction of actuation. It is furthermore disadvantageous that the bifurcated spring ends exhibit the same flexibility at the opening as at the closing of the contact couple.

In view of this problem, German Auslegeschrift No. 2,454,967 suggests an arrangement in which the contact couple is positively and forcibly opened, whereas the closing of the contact couple is done solely by pre-tensioning the contact spring. However, this arrangement allows only a small proportion of the pull provided by the armature to be stored in the contact spring.

It is an object of the present invention to provide a contact spring arrangement for a polarized relay which not only stores an essential portion of the permanent-magnetic pull exerted by the armature in a contact spring as the contact force, but also ensures a positive and forced opening of the contact couple with a contact clearance which is not reduced by any contact spring bending.

It is a further object of the present invention to provide a contact arrangement as set forth above, which is easy to manufacture and assemble from a minimum of structural components.

SUMMARY OF THE INVENTION

The polarized electromagnetic relay according to this invention includes two adjacent contact springs mounted on terminals, a first one of the springs having a portion serving as a movable contact for cooperation with a fixed contact, free ends of the two contact springs touching each other in the contacting condition of said fixed and movable contacts, and an armature having first and second actuator portions for engaging the two contact springs in the vicinity of said movable contacts, the first actuator portion serving to move the movable contact towards the fixed contact and the second actuator portion serving to withdraw the movable contact from the fixed contact, wherein the positioning force of the armature, when displaced from its zone of zero force, increases progressively to a final pull, and wherein $$L_3/h < L_1/h',$$

where $L_3$ is the spring length from the second actuator portion to the movable contact, $L_1$ is the spring length from the first actuator portion to the touching location of the two contact springs, and h and h' are the thicknesses of the springs on the lengths $L_3$ and $L_1$, respectively.

Such an arrangement permits the storing of an essential portion of the permanent-magnetic pull provided by the armature in the contact springs and guarantees a forced contact opening even in case the contact couple should have become stuck together, with a clearance unaffected by any spring bending. Moreover, the presence of two contact springs permits a greater current load.

DETAILED DESCRIPTION OF PREFERRED EMBODIMENTS

Figure 1:
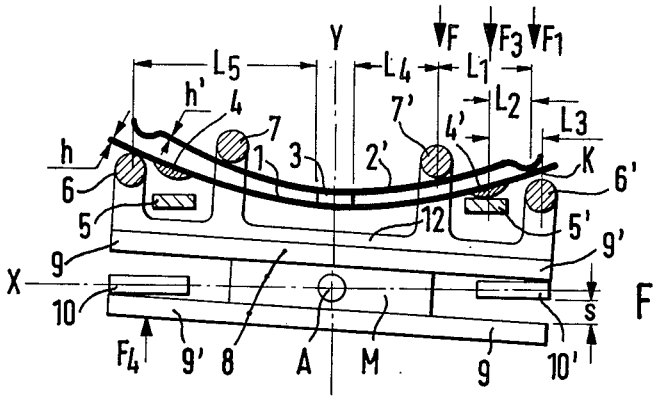
FIG. 1 is a cross-sectional view showing a contact spring arrangement for a polarized electromagnetic relay according to a first embodiment of this invention.

In the arrangement shown in FIG. 1, a permanent-magnetic armature 8 of a polarized relay having a magnet M is pivoted about an axis passing through its center of gravity A between pole shoes 9, 9' and is depicted in one of two rest positions. The magnet M is partially embedded and thus fixed in a manner known per se by the synthetic material of an actuator 12. The armature 8 and the actuator 12 form a unit with actuator portions 6, 7, 6' and 7' integrally formed on the actuator. The arrangement of FIG. 1 is mirror-symmetric with respect to both the X axis and the Y axis, but not shown completely for simplicity. The armature 8 is shown in one of its end positions in which the pole shoes 9' have travelled through a distance s and bear against the pole ends 10, 10' of a coil core (not shown) with a force $F_4$. Fixed contacts 5, 5' are disposed laterally of the X axis of the armature 8, and a contact terminal 3 to which contact springs 1, 2' are fixedly connected with their centers is disposed in the middle between the fixed contacts. The free ends of the contact spring 1 are provided with portions forming movable contacts 4, 4' opposite the fixed contacts 5, 5'. The contact spring 2' extends at the side of the contact spring 1, which functions as a double-throw contact. Both springs 1, 2' are provided with a small bias force $F_K$ (FIG. 8) with respect to the actuator portions 6, 7 and 6', 7' which are disposed in close proximity of the fixed contacts 5, 5' and the movable contacts 4, 4'. At the moment of contact closure, the movable contact, e.g. 4', engages the fixed contact 5' with the bias force $F_K$. The actuator portion 6' then releases the contact spring 1, and the actuator portion 7' presses with a force F on the spring 2' which, with its length $L_1$ exerts a force $F_1$ on the location K at which it touches the contact spring 1. This force $F_1$ is thus transmitted by the contact spring 1 through its length $L_2$ on the contact 4', 5' and added to the bias contact force $F_K$. This type of contact closure surpresses any contact chattering because the force $F_1$ cancels already at the moment of contact closure any oscillations that may be produced by the movable contact 4' hitting the fixed contact 5'.

A further advantage of the double contact spring according to the present invention resides in the branching of the contact current. One portion of this current flows from the contact couple 4', 5' through the contact spring 1 to the contact terminal 3, as usual, while the rest of the current flows from the contact spring 1 in the opposite direction through the touching point K and the spring 2' to the contact terminal 3. Still a further advantage will be recognized by considering the formula for calculating the bending, which includes the ratio $L^3:h^3$. For instance, if the spring length L equals 1 and the thickness h equals 0.1, the ratio $L^3:h^3$ equals 1000. If the single thickness of 0.1 is replaced by twice the thickness of 0.05, the same cross-sectional area will result in a ratio $L^3:2\times h^3=1^3:2\times 0.05^3=4000$. If twice a thickness of 0.075 is selected, the ratio $L^3:h^3$ becomes 1135, which means 50 percent more cross-sectional area and an accordingly higher allowable current load with approximately equal spring properties. In practice, however, the permissible current load of the double contact spring according to the invention is even higher because the entire surface is about twice as large as with a single spring of similar resilient properties. This improves the dissipation of heat and at the same time reduces the resistance for high-frequency currents due to skin effect.

For realizing the respective desired spring properties and stiffness of the contact springs used, the widths of the springs may also be varied. In contrast to a variation in the spring length and thickness, however, a variation in widths affects the bending of the contact springs only linearly.

During contact closure, the spring constant should be very small within the range x of spring excursion (compare FIG. 4) and should increase with an average gradient in the subsequent range of contact closure movement, in order to achieve proper storing of permanent-magnetic pull for the contact force and for obtaining stable pull-in and drop-out values of the relay. The same properties should be guaranteed even in case the contact clearance increases due to contact burn-off. On the other hand, in the forced contact opening, the spring constant should increase with a very large gradient, which means that the spring section then effective must be stiff. For this reason, the spring length $L_2$ between the contacting position of the movable and fixed contacts 4', 5' and the actuator portion 6' is made as short as possible. In case any arcing that may occur should require a larger clearance between the contact to the actuator portion 6', which consists of synthetic material, a forced contact opening may be achieved by providing the contact spring 1 either with a stiffening embossed profile 13 (FIG. 6) or, as an equivalent measure, with a thickness h which is larger than the thickness h' of the more flexible contact spring 2. This is unproblematic because the relatively great spring length $L_5$ is effective with a very small spring constant upon opening of the contact couple.

Figure 2:
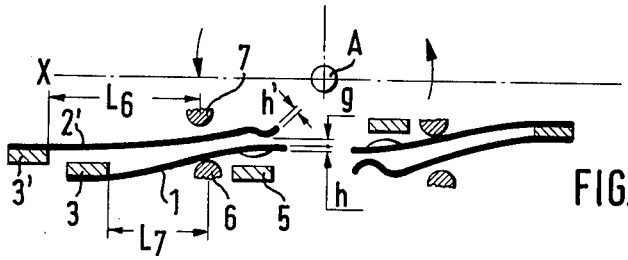
FIG. 2 is a view similar to FIG. 1 of a second embodiment.

In the embodiment shown in FIG. 2, two normally open contact couples are disposed again laterally of the X axis of an armature (not shown) which contact couples are closed when the armature is pivoted about its axis A in the direction of the arrows as described above. The present embodiment includes a further possibility to make the spring 2' even more flexible with respect to the contact spring 1 by varying the length ratio $L_6:L_7$ in addition to the ratio of the spring thicknesses h:h'. This may be done by mounting the two contact springs 1, 2' on differently positioned contact terminals 3, 3' which may be connected externally or remain separate. An electric separation, however, is useful only for high switching voltages and low switching currents because the additional air gap g will increase the breakdown voltage. Moreover, the second contact terminal 3' provides for a better adjustment, which is available also in case the two contact terminals 3, 3' are bifurcated and joined in a carrier portion consisting of synthetic material (as known per se) to form one single terminal pin extending from the base of the relay. In order to obtain the symmetry of forces shown in FIG. 8, two normally closed contact couples may be provided on the other side of the X axis, or the second contact couple disposed on the same side may be designed with corresponding geometry to provide an analogous force dependency on the travelling-distance.

Figure 3:
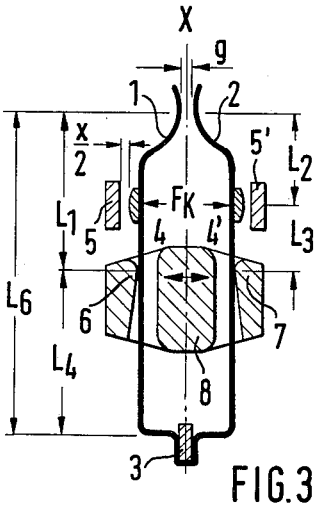
FIGS. 3 and 4 show a contact spring arrangement according to a third embodiment of the invention in two different switching positions.
Figure 4:
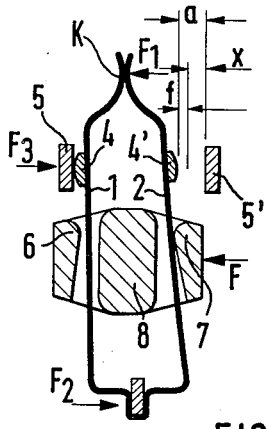

In the arrangement of FIGS. 3 and 4, a double-throw contact is disposed at an end of the armature 8. FIG. 3 represents the contact arrangement in its central position, while FIG. 4 represents the arrangement in one of its end positions. In this embodiment, the two contact spring members 1, 2 are formed from one resilient strip which is provided with two movable contacts 4, 4' opposite the fixed contacts 5, 5' and is centrally connected to a contact terminal 3. The two contact members 1, 2 are symmetrical with respect to the X axis. In close proximity to the contacts 4, 5 and 4', 5', the two spring members of this double contact spring bear with a small bias force $F_K$ against actuator portions 6, 7 which consist of synthetic material and are formed integrally with the armature 8. The free ends of the spring members extend beyond the movable contacts 4, 4' and are bent towards each other in such a manner that a small air gap g is formed at a distance $L_2$ from the movable contacts, the size of the air gap g being determined in accordance with the requirements of a proper storage of permanent-magnetic pull. It is also possible to omit the air gap g so that the spring members touch each other in all positions of the armature.

In actuation, as shown in FIG. 4, the actuation force F acts on the spring 2 and is distributed to the contact terminal 3 at the ratio $(F\cdot L):L_6=F_2$ and to the touching location K at the ratio $(F\cdot L_4):L_6=F_1$ which latter force correspondingly increases the contact force $F_3$. The thus caused bending of the spring 2 increases the geometrically determined contact clearance x by the width f of spring excursion during the switch-over process. The contact clearance available in the final condition of contact closure is $a=x+f+g'$, where the gap $g'=g(L_3+L_4):L_6$. As may be understood, the contact clearance a in the final switching condition may be larger than the travelling distance s of the armature, if the ratio $(L_3+L_4):L_6$ is properly selected. In this case, however, the contact force $F_3$ is reduced.

Figure 5:
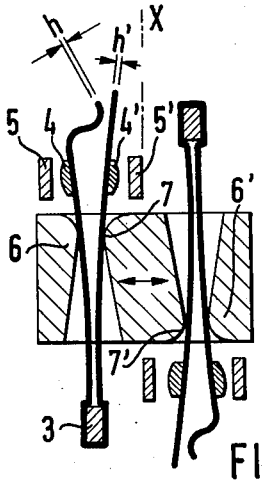
FIG. 5 illustrates a fourth embodiment of this invention.

The embodiment of FIG. 5 operates on the same principle as that of FIGS. 3 and 4 but has two pairs of double-throw contact systems disposed at the side of each other and at an end of the relay. The opposite end of the relay may be provided with the same contact arrangement or with the one shown in FIG. 3, thereby providing a polarized relay having the double contact spring of the present invention and two, three or four pairs of double-throw contacts, in which all contacts 4, 5, 4', 5' are positioned in close proximity to the axis X, thereby rendering the wear of the actuator portions 6, 7 with respect to the contacts to be actuated very small.

Figure 6:
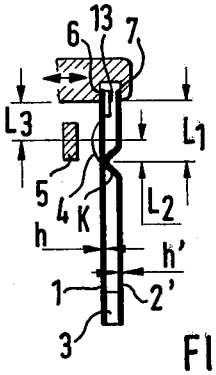
FIGS. 6 and 7 are a cross-sectional and, respectively, a perspective view of a fifth embodiment of the invention and of a variation thereof.
Figure 7:
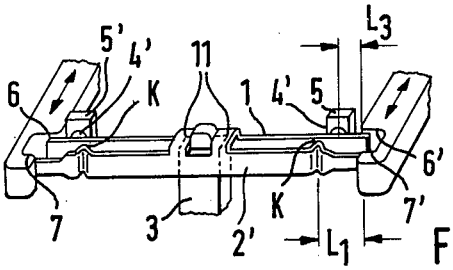

FIGS. 6 and 7 represent a contact spring arrangement in which the touching point K between the contact springs 1, 2' is defined by a dent formed in the spring 2'. The actuator portions 6, 7 of an armature (not shown) engage the outermost portions of the free ends of the contact springs 1, 2', while the touching point K is in the area of the contacts 4, 5, and 4', 5' so that the contact current is branched into both springs 1 and 2'.

In detail, FIG. 6 shows a normally open contact in which the springs 1, 2' have their one ends mounted on a terminal 3 and electrically connected to each other. For contact closure, the actuator portion 7 presses the contact spring 2' to the left in FIG. 6 until the movable contact 4 provided on the spring 1 engages the fixed contact 5. If the springs 1, 2' are biassed against the actuator portions 6, 7, the contact couple is closed with an according bias contact force $F_K$. In the further movement, the spring force $F_1$ (FIG. 8) transmitted from the spring 2' through the dent on the touching point is added to this bias contact force $F_K$. It is mainly the spring length $L_1$ of the contact spring 2' which determines the amount of permanent-magnetic pull M' stored as the contact force $F_3$.

In the opposite actuation, i.e. in the opening of the contact couple 4, 5, the actuator portion 6 moves to the right in FIG. 6 and—due to the stiffness of the spring length $L_3$—forcibly withdraws the movable contact 4 from the fixed contact 5. In case the required spring characteristic of the length $L_1$ or the stiffness of the length $L_3$ cannot be realized by their ratio alone, the contact spring 1 may be provided with a thickness h which is greater than the thickness h' of the spring 2'. The same may be achieved by selecting different spring widths, although the spring characteristic varies only linearly in response to the width.

The arrangement of FIG. 7 is formed as a double-throw contact, the actuation of both contact couples 4, 5 and 4', 5' being performed in the same manner as shown in FIG. 6. Other than in FIG. 6, the contact springs 1, 2' are integrally formed and fixed centrally to the contact terminal 3, with two resilient sections extending to each side. The sections extending somewhat parallel to each other on both sides of the terminal 3 are connected by webs 11. The contact springs 1, 2' thus form one single punched and bent piece of sheet metal which is positioned on the terminal 3 by the two webs 11 prior to being finally secured by spot welding or the like.

Figure 8:
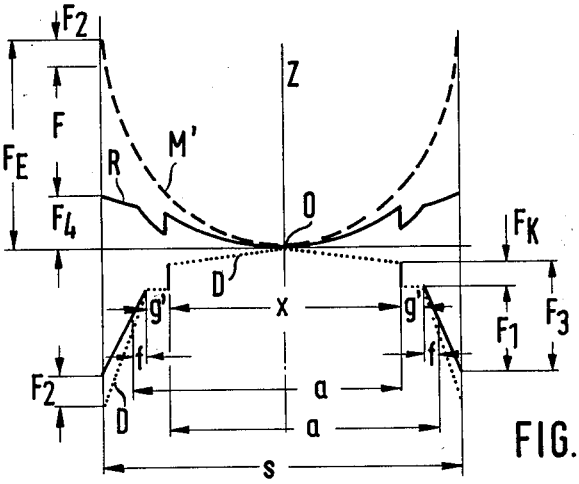
FIG. 8 is a graph used for explaining the above embodiment, in which graph various forces are plotted against the travelling distance.

FIG. 8 finally represents the force-travelling distance characteristic of the embodiments described above in connection with FIGS. 1 to 7. The broken curve M' which rises progressively from the center O represents the permanent-magnetic pull acting on the pole shoes 9, 9' of the armature 8 during the path of travel s in the absence of excitation. The represented characteristic of the permanent-magnetic pull M' which is symmetrical with respect to the Z axis is useful when a bistable switching behavior, i.e. an arrangement with rest positions on both sides, is desired. The Z axis may be offset from the center of the armature travelling distance, for instance when an asymmetric rest position on one side resulting in one normally-closed contact is intended. This may be achieved for instance by pole surfaces 9, 9' of different size.

In the present case, the forces of the contact spring members 1, 2, 2' individually and in combination counteract the permanent-magnetic pull M' according to the dotted lines D. In accordance with the geometry shown, the force F applied by the actuator portions 6, 7, on the springs 1, 2, 2' is divided so that a smaller proportion $F_2$ acts on the contact terminal 3, 3' and a large proportion $F_3$ acts through the touching point K of the springs 1, 2, 2' on the contacts 4, 5 or 4', 5', respectively. Within the distance x of contact travel, the counter forces exerted by the springs are insignificant. In the moment of contact closure, biassed springs create a bend or step in the characteristic which marks the bias contact force $F_K$. Since the contact force thus neither starts at zero nor corresponds to the relatively high final contact force, the danger of the contact couple to become welded together is substantially diminished. Similarly, the danger of contact chattering is reduced by the comparatively smooth engagement between the fixed and movable contacts. Safety and life of the contacts are considerably increased by this measure.

In case a gap g exists between the free ends of the springs 1, 2 or 2' during the deflection, the force counteracting F increases during the closing of this gap g by the actuation of the spring 2 or 2'. The contact force, however, is not increased thereby, because no force is transmitted from the spring 2 on the spring 1. Since the increase of force counteracting F during the closure of the gap g is negligible, it is not shown in the graph of FIG. 8. When the springs 1, 2 touch each other in the closed condition of the air gap g, the transmission of spring force increases the contact force by $F_1$ to $F_3$, by which the positioning force of the armature is reduced. In the final condition, the excitation energy need only be sufficient to overcome the relatively small final positioning force of the armature 8 in order to change the switching state of the relay. On the other hand, practically no excitation energy is required for the relative large contact force $F_3$, which is of particular importance in view of the fact that the contact clearance a is relatively large with respect to the travelling distance s of the armature, and in view of the positive and forced contact opening. These advantages are achieved by properly adjusting the contact springs for the two different purposes of contact closure and contact opening, which contact springs additionally share the load of the contact current.

The invention thus promotes the compensation of temperature influences for achieving a constant pull-in voltage as disclosed in U.S. Pat. No. 3,634,793 as well as the application of the so-called C-circuit in modern relay technology. A C-circuit by which bistable relays may be operated in mono-stable fashion, is known for instance from H. Sauer "Relais Lexikon", 1975, page 12, (shown in FIG. 9) and from "Elektronik", vol. 60, issue 24 of Dec. 27, 1978, page 43.

Figure 9:
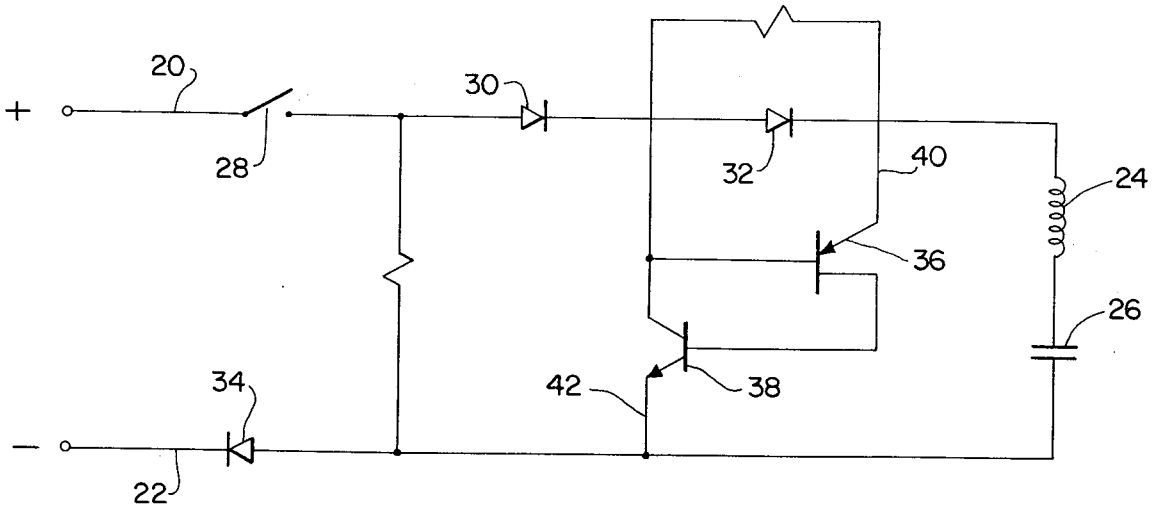
PRIOR ART FIG. 9
FIG. 9 is a schematic diagram showing a C-circuit which may be used with the present invention.

The circuit shown in FIG. 9 comprises input terminals 20 and 22 which provide supply voltage to the series combination of a relay coil 24 and capacitor 26. When the relay is to be activated, switch 28 is closed. Positive current passes through zener diode 30, diode 32, coil 24, capacitor 26 and diode 34 to excite coil 24. Positive current continues to flow until capacitor 26 becomes fully charged.

A circuit comprising transistor 36 and 28 has an output circuit including terminals 40 and 42 connected in parallel across the series combination of coil 24 and capacitor 26. When switch 28 is opened, a negative current path is established for the base of transistor 36 through zener diode 30 and resistor 40, thus rendering transistor 36 conductive. Conduction of transistor 36 produces a positive current at the base of transistor 38 rendering that transistor conductive. Transistor 38 latches transistor 36 in the conductive state and terminals 40 and 42 effectively become shorted to provide a negative exciting current from capacitor 26 through coil 24, thereby resetting the relay to its rest position. As indicated above, the invention achieves a satisfactory storage of permanent-magnetic pull as the contact force in addition to the often required forced contact opening. It is therefore only necessary to determine the final positioning force F4 of the armature 8 in consideration of the temperature coefficient of a BaOFe or similar permanent magnet M in such a manner that the centrally pivoted and therefore balanced armature 8 is safely maintained in its desired position over the entire range of operating temperatures even under shock influences. A small final positioning force F4 is useful in the C-circuit, because the pull-in power for which the storage capacitor controlling the function of the C-circuit depends on this final positioning force. The smaller the pull-in power of the relay is, the smaller is the capacity which the capacitor connected in series with the coil may have. The capacitor is charged when the power is switched on and blocks the flow of current through the coil until it is discharged in the other direction through the coil and a multivibrator, thereby resetting the relay armature to its rest position, when the power is switched off. This is of particular significance in safety circuits for which a forced guidance of the movable contacts is prescribed, because it is not only impossible to over-excite the relay in case of an over-voltage in the excitation circuit, but the relay is also prevented from being re-excited due to the blocking of the current flow upon the switch-on process which takes only a few milliseconds. Therefore, no heat will be generated any more. The reliability and life of the relay and any structural elements existing in the vicinity of the relay are thus substantially increased.

I claim:

1. A relay including:

a stationary contact;

a first contact spring having a movable contact mounted thereon, said first contact spring being movable between a first position wherein said movable contact contacts said stationary contact, and a second position wherein said movable contact is spaced from said stationary contact;

a second contact spring disposed adjacent said first contact spring; said second contact spring containing a portion touching said first contact spring when said first contact spring is in said first position;

armature means for moving said first contact spring between said first and second positions; said armature means including first actuator means for operatively engaging said second contact spring at a predetermined area and biasing said second contact spring against said first contact spring at said portion; and second actuator means for engaging said first contact spring at a predetermined area and moving said first contact spring to said second position; and wherein $L_3/h < L_1/h'$;

$L_1$ is the length measured along said second contact spring between said area of operative engagement of said second contact spring with said first actuator means and said portion of said second contact spring;

$L_3$ is the length measured along said first contact spring between said area of engagement of said first contact spring with said second actuator means and said movable contact;

h is the thickness of said first contact spring; and h' is the thickness of said second contact spring.

2. The relay of claim 1 wherein h and h' are different values.

3. The relay of claim 1 wherein said portion is spaced along said first contact spring from said movable contact.

4. The relay of claim 1 wherein said first contact spring is pretensioned against said second actuator means.

5. The relay of claim 1 wherein said first and second contact springs have different lengths.

6. The relay of claim 1 wherein said portion comprises a dent formed in one of said first and second contact springs.

7. The relay of claim 1 wherein said first and second actuator means engage free ends of said second and the first contact springs, respectively, said portion being disposed adjacent said movable contact for providing a current path through each of said first and second contact springs.

8. The relay of claim 1 wherein said first and second contact springs are formed in one piece, said one piece having an intermediate portion mounted on a terminal and a pair of adjacent portions extending from each of two sides of said terminal, each pair of adjacent portions being connected by a web.

9. The relay of claim 8 wherein said two webs position said one piece on said terminal.

10. The relay of claim 1 wherein said first and second contact springs are connected to a common terminal.

11. The relay of claim 1, further including a relay coil, a capacitor connected in series with said relay coil, circuit means for supplying said relay coil and said capacitor with an excitation voltage, and semi-conductor switch means having an output circuit connected in parallel with said relay coil and said capacitor for short circuiting said relay coil and said capacitor.

12. The relay of claim 1 in which said armature means includes a permanent magnet and wherein the permanent magnet is constructed such that the influence of temperature coefficients on the positioning force of said armature means is greater due to said contact springs than the field of said permanent magnet.

* * * * *